United States Patent [19]

Block

[11] Patent Number: 4,655,006

[45] Date of Patent: Apr. 7, 1987

[54] ABRASIVE APPARATUS

[76] Inventor: Aleck Block, 800 Warner Ave., Los Angeles, Calif. 90024

[21] Appl. No.: 692,235

[22] Filed: Jan. 17, 1985

[51] Int. Cl.[4] ..... B24B 41/00

[52] U.S. Cl. ..... 51/168; 51/378

[58] Field of Search ..... 51/378, 168, 376

[56] References Cited

U.S. PATENT DOCUMENTS

| | | | |
|---|---|---|---|
| 507,223 | 10/1893 | Hyde | 51/168 |
| 566,883 | 9/1896 | Alden | 51/168 |
| 2,417,680 | 3/1947 | Decker | 51/378 |
| 2,726,493 | 12/1955 | Young | 51/168 |
| 3,500,592 | 3/1970 | Harrist | 51/376 |
| 3,596,415 | 8/1971 | Donahue | 51/378 |
| 3,757,328 | 9/1973 | Wakefield | 51/376 |
| 3,800,483 | 4/1974 | Sherman | 51/376 |
| 3,808,753 | 5/1974 | Maran | 51/378 |
| 3,844,072 | 10/1974 | Haigh | 51/378 |
| 3,883,998 | 5/1975 | Dosser | 51/376 |
| 4,354,328 | 10/1982 | Ainoura | 51/168 |
| 4,439,953 | 4/1984 | Block | 51/378 |

*Primary Examiner*—Harold D. Whitehead

*Attorney, Agent, or Firm*—Ellsworth R. Roston; Charles H. Schwartz

[57] ABSTRACT

An arbor is threaded in a first direction. An adaptor bushing is disposed on the arbor and is externally threaded in a second direction opposite to the first direction. A reinforcing plate is rotatable on the adaptor bushing in the second direction. A detent arrangement may be provided on the adapter bushing and the reinforcing plate to limit the movement of the reinforcing plate relative to the adaptor bushing. An abrasive wheel or disc is provided with first and second opposite surfaces and abrasive particles are disposed throughout the disc. A nut is disposed in a bore in the disc and is threaded for rotation on the arbor in the first direction. When the disc engages the reinforcing plate, continued rotation of the disc in the first direction causes the reinforcing plate to rotate in the second direction and to press against the disc. When the disc is to be released, it is rotated in the second direction, thereby producing a movement of the reinforcing plate in the first direction to release the disc from the reinforcing plate. A yieldable detent relationship may be provided between the reinforcing plate and the disc to facilitate a coupling action between them in accordance with rotation of the disc in the first direction and to facilitate a releasing action on the disc in accordance with the rotation of the disc in the second direction.

45 Claims, 9 Drawing Figures

ABRASIVE APPARATUS

This invention relates to abrasive apparatus and more particularly relates to abrasive apparatus in which an abrasive disc or wheel can be easily and quickly coupled to the abrasive apparatus and can be easily and quickly removed from the abrasive apparatus. The invention also relates to the abrasive disc or wheel and to the combination of the abrasive disc or wheel and the abrasive apparatus.

Abrasive apparatus is used to remove material from a workpiece so as to provide desired dimensions in the workpiece. Abrasive apparatus is also used to polish and smooth surfaces of the workpiece. One type of apparatus employs a support plate which rotates an abrasive disc or wheel. The apparatus includes an arbor and an internally threaded nut which is screwed on the arbor to hold the disc or wheel in fixed position ont he arbor. When the disc or wheel is screwed on the arbor, the disc or wheel is applied against the workpiece to abrade, polish or smooth a surface of the workpiece.

During the time that the abrasive disc is being rotated and is being applied against the workpiece, the force of the workpiece against the disc causes the disc to become tightened against the holder. The tightening is sometimes so great that the disc cannot be removed from the holder, even when a great force is applied to the disc to loosen the disc from the holder. Since discs wear relatively quickly, an inability to remove a worn disc from the holder is aggravating and time consuming and inefficient from a cost standpoint.

A considerable amount of time, and a substantial investment of money, have been expended in attempting to solve the problems specified in the previous paragraph. In spite of such efforts, such problems still persist. The abrasive disc still cannot be easily released after they have been operated against the workpiece. Furthermore, the nut holding the disc on the arbor often becomes lost or misplaced when the disc is removed from the arbor.

This invention provides a holder and an abrasive disc which eliminate the problems specified above. The holder and the abrasive disc are constructed to provide a quick and easy release of the disc from the holder when a force is applied to the disc to rotate the disc in the release direction after the disc has been forced against the workpiece during operation.

In one embodiment of the invention, an arbor is threaded in a first direction. An adaptor bushing is disposed on the arbor and is externally threaded in a second direction opposite to the first direction. A reinforcing plate is rotatable on the adaptor bushing in the second direction. A detent arrangement may be provided on the adaptor bushing and the reinforcing plate to limit the movement of the reinforcing plate relative to the adaptor bushing.

An abrasive wheel or disc is provided with first and second opposite surfaces and abrasive particles are provided throughout the disc. A nut is disposed in a bore in the disc and is threaded for rotation on the arbor in the first direction. When the disc or wheel engages the reinforcing plate, continued rotation of the disc in the first direction causes the reinforcing plate to rotate in the second direction and to press against the disc.

When the disc is to be released, it is rotated in the second direction, thereby producing a movement of the reinforcing plate in the first direction to release the disc from the reinforcing plate. A yieldable detent relationship may be provided between the reinforcing plate and the disc to facilitate a coupling action between them in accordance with rotation of the disc in the first direction and to facilitate a releasing action on the disc in accordance with the rotation of the disc in the second direction.

Figure 1:
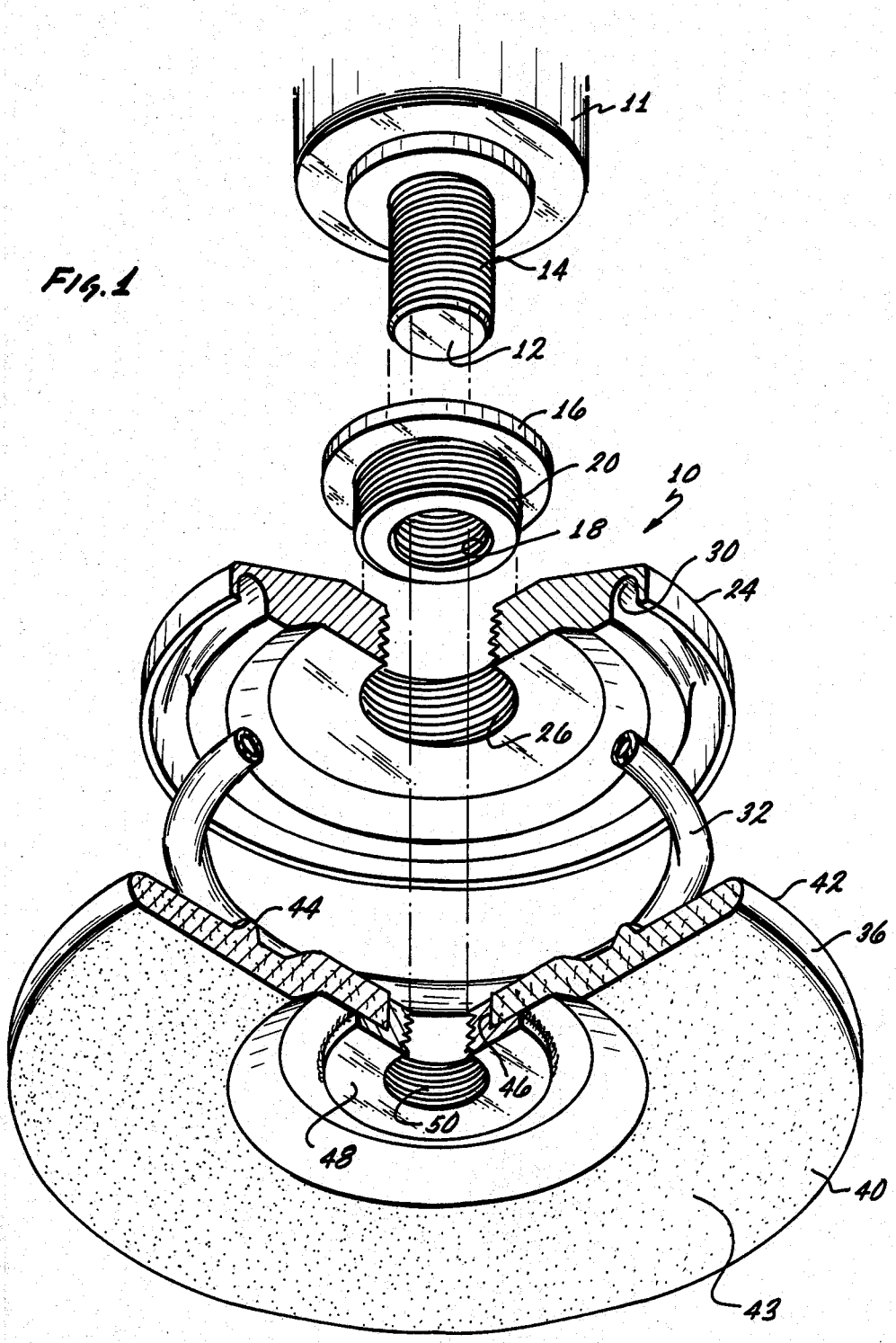
FIG. 1 is an exploded perspective view, with certain parts broken away, of one embodiment of a holder and an abrasive disc or wheel constituting one embodiment of the invention.

In one embodiment of the invention, a holder generally indicated at 10 is adapted to be rotated by a motor 11. The holder includes an arbor 12 externally threaded as at 14. An adaptor bushing 16 is provided with a bore internally threaded as at 18 and is externally threaded as at 20. The threads 18 may be right hand threads compatible with the threads on the arbor 12, and the threads 20 may be left hand threads.

A reinforcing plate 24 is provided with a bore internally threaded as at 26 for compatibility with the threads 20 on the bushing 16. The reinforcing plate 24 is indented at a position near the internal threads 26 and is provided with an annular cavity 30. Detent means such as a yieldable member 32 is retained in the cavity 30 and is adapted to be compressed upon the exertion of a force against the member.

A disc generally indicated at 36 is operatively associated with the holder 10. The disc 36 is made from a stiff material such as phenolic resin. Abrasive particles 38 made from a suitable material such a silicon carbide are dispersed throughout the phenolic resin. The disc may be cold formed and then heated until the material sets in the position where its center area is depressed as shown in FIGS. 2 through 5. The disc 36 is provided with first and second spaced but parallel surfaces 40 and 42. Detent means such as a suitable projection 44 may be annularly provided on the surface 42 at a position corresponding to that of the yieldable member 32 on the reinforcing plate 24.

The disc or wheel 36 is provided with a central bore 46 and a nut 48 internally threaded as at 50 is disposed in the bore 46. The nut 48 abuts the bore 46 and the surface 40 adjacent the bore 46 and is suitably adhered to these surfaces. The nut 48 has a barrel portion 49 which preferably does not extend beyond the surface 42 on the disc 36. As shown in FIGS. 2 through 5, the barrel portion 49 of the nut 48 preferably terminates at a position within the bore 46 because the barrel portion of the nut has a length less than the thickness of the disc 36. The internal threads on the nut 48 are compatible with the threads on the arbor 12.

Figure 2:
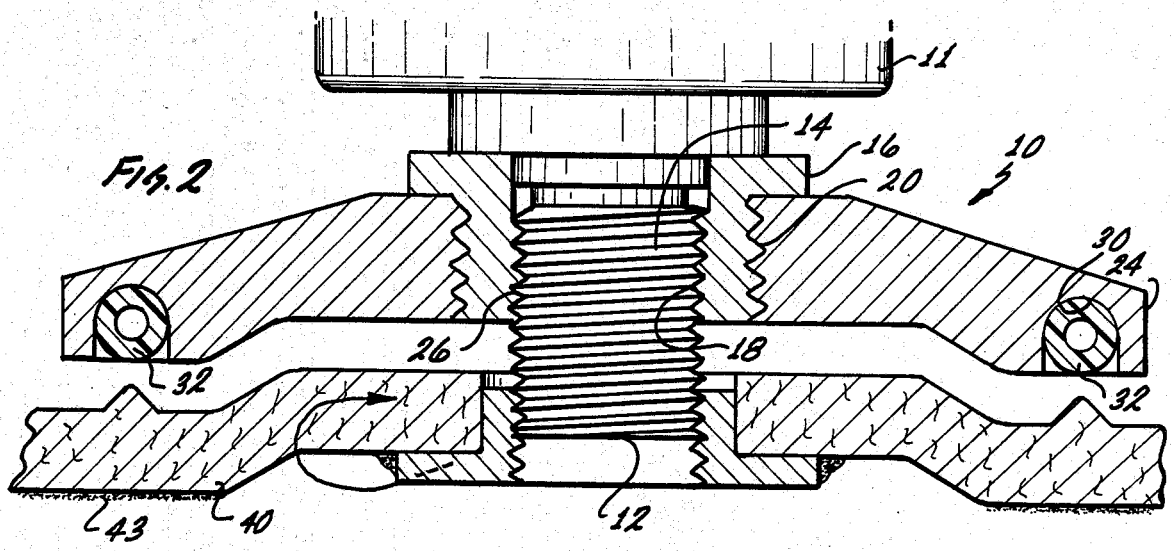
FIG. 2 is a sectional view of the embodiment of the abrasive holder and disc of FIG. 1 in a partially assembled relationship.
Figure 3:
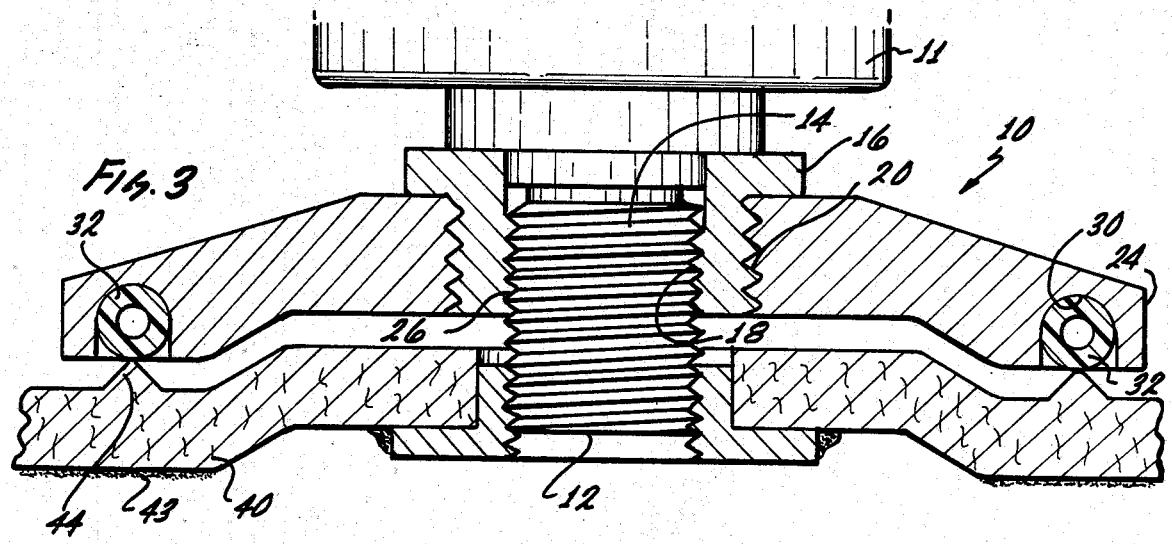
FIG. 3 is a sectional view similar to that of FIG. 2 and shows the embodiment of the holder and the abrasive disc in a partially assembled relationship but one more advanced than that shown in FIG. 2.

FIG. 2 illustrates the disposition of the disc 36 on the arbor 12 before the disc contacts the reinforcing plate 24. As the disc continues to move in a first direction (upwardly in FIG. 2) along the arbor 12, it engages the reinforcing plate 24 as shown in FIG. 3. This engagement occurs between the projection 44 on the disc 36 and the yieldable member 32 on the reinforcing plate 24. When this engagement occurs, any further rotation of the disc 36 causes the reinforcing plate 24 to move downwardly in FIG. 2 because of the left hand threads provided on the reinforcing plate. The holder 10 and the disc 36 accordingly assume the relative positions shown in FIG. 4. This is the position which the disc 36 has relative to the reinforcing plate 24 when the disc is manually screwed on the arbor.

Figure 4:
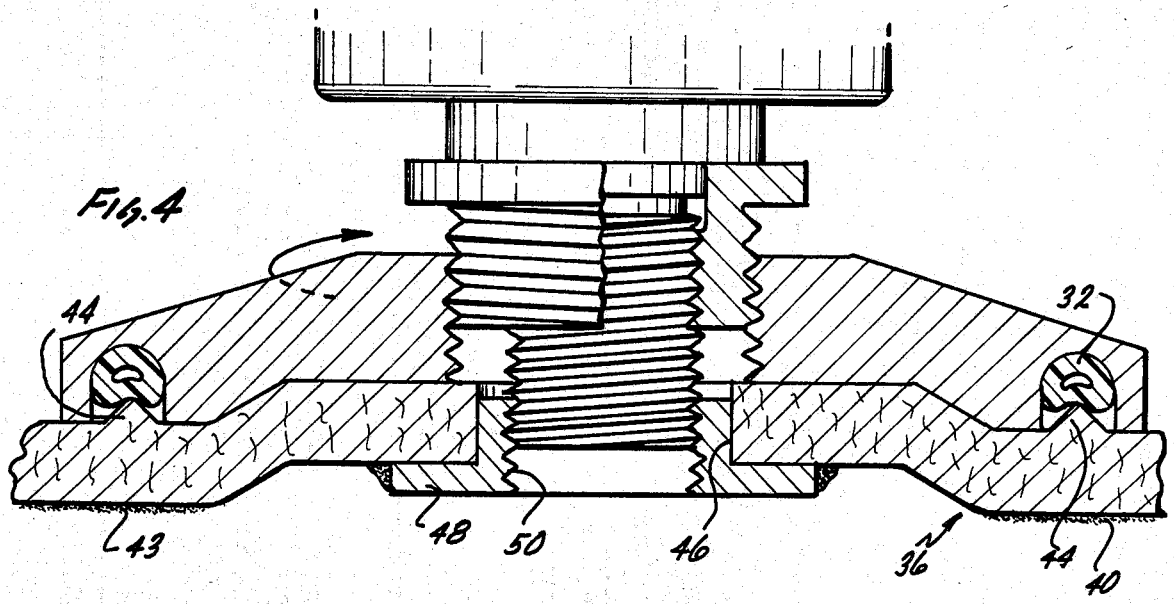
FIG. 4 is a sectional view similar to that shown in FIGS. 1 and 2 but shows the embodiment of the holder and the abrasive disc in an assembled relationship.
Figure 5:
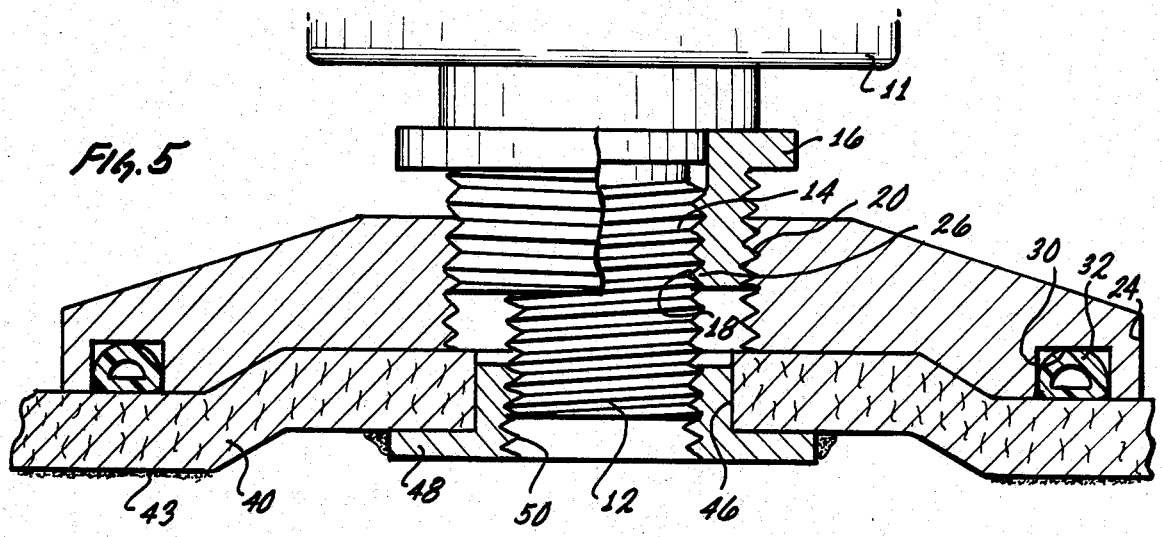
FIG. 5 is a sectional view similar to that shown in FIGS. 1, 2 and 3 but shows the embodiment of the holder and the disc in a relationship more closely coupled than that shown in FIG. 4 as a result of the force exerted on the disc by a workpiece.

The apparatus shown in FIGS. 1 through 4 is ready to be applied to a workpiece (not shown) when the holder 10 and the abrasive disc 36 have the relative positions shown in FIG. 4. The force exerted by the workpiece against the disc 36 during the rotation of the disc and during the application of the disc against the workpiece tends to cause the holder 10 and the disc 36 to assume the relative positions shown in FIG. 5. As will be seen in FIG. 5, the holder 10 and the disc 36 have an even closer coupling than that shown in FIG. 4.

When the disc 36 becomes worn, it may be desired to replace the worn disc with an unused unit. To do so, a force is applied to the worn disc 36 on the arbor 10 to move the disc away from the reinforcing plate 24 because of the left hand threads on the reinforcing plate. This movement to disassociate the disc 36 from the arbor 10 is facilitated by the counter movements of the disc and the reinforcing plate 24. As a result, it is considerably easier to uncouple the disc 36 from the holder 10 than in the discs and holders of the prior art.

Figure 6:
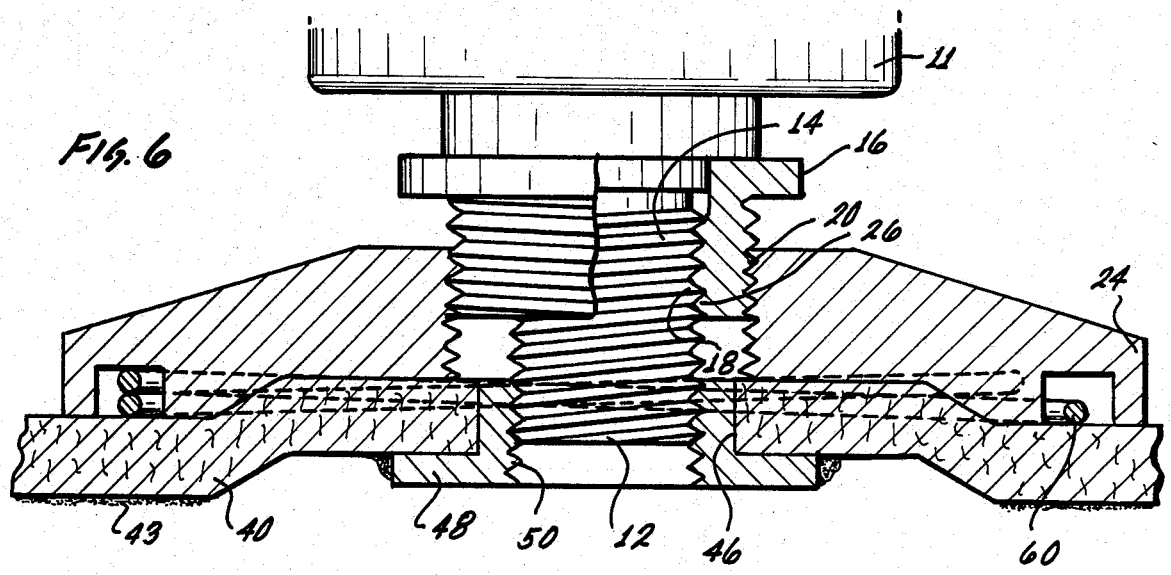
FIG. 6 is a sectional view of another embodiment of the holder and the abrasive disc shown in FIGS. 1 through 5.
Figure 7:
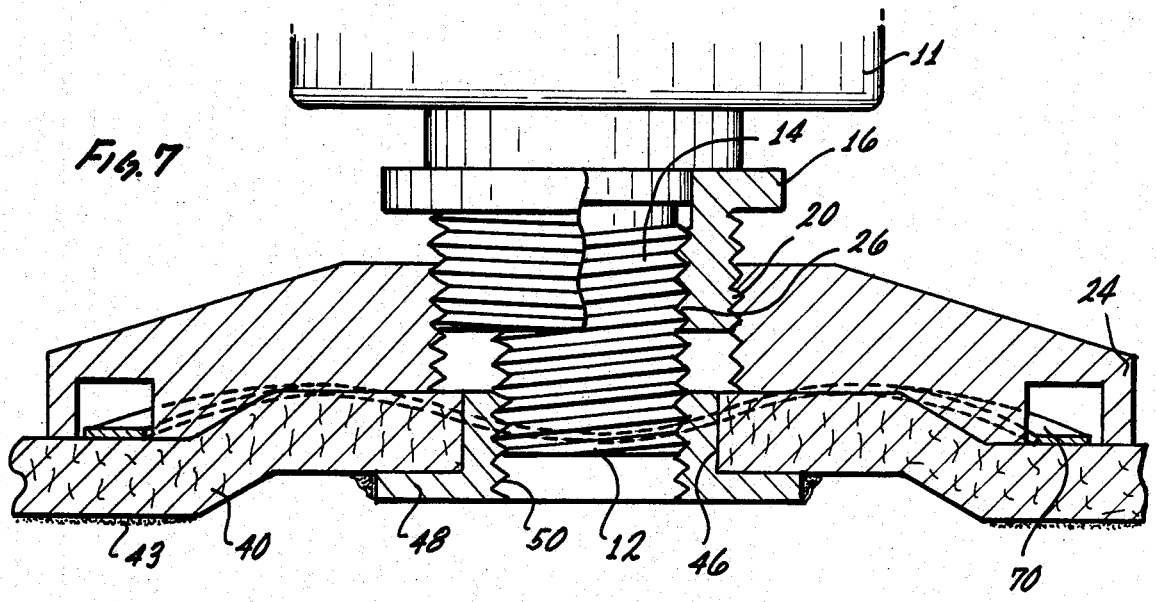
FIG. 7 is a sectional view of a further embodiment of the holder and the abrasive disc.
Figure 8:
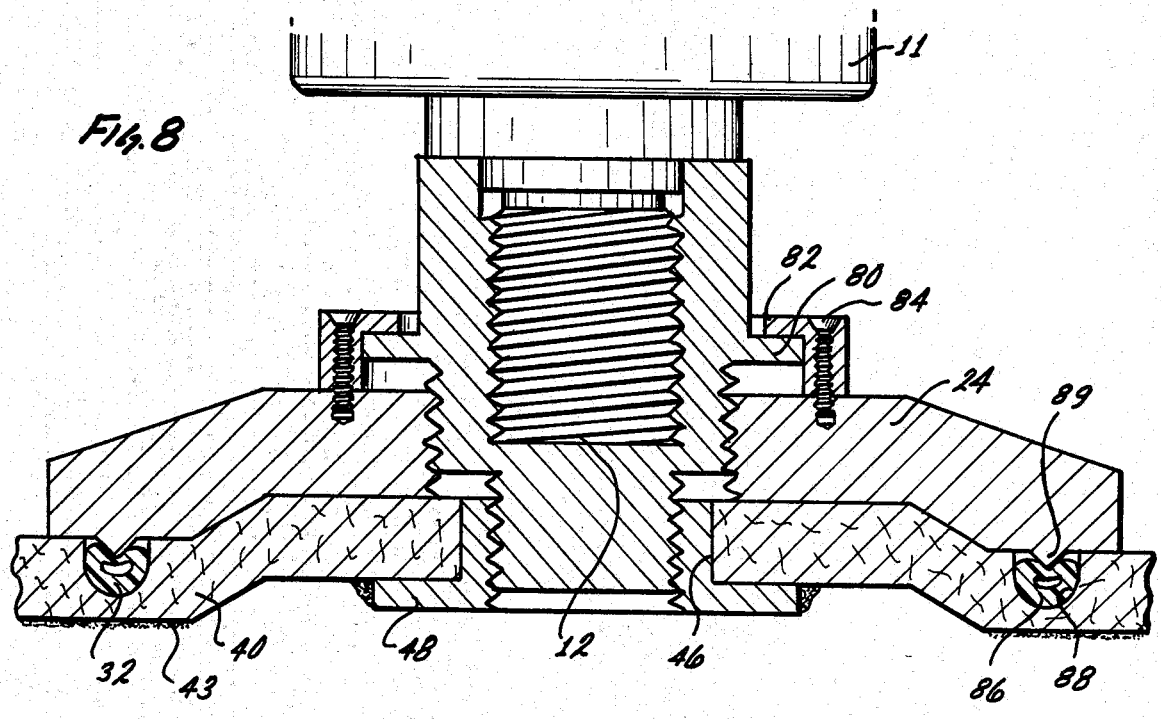
FIG. 8 is a sectional view of still another embodiment of the holder and the abrasive disc.

It will be appreciated that the positions of the projection 44 and the yieldable member 32 can be reversed. This is shown in FIG. 8 by a projection 62 on the reinforcing plate and a yieldable member 64 on the disc. The yieldable member 32 can also be replaced by a spring 60 (FIG. 6), such as a helical spring, which can be provided with more than one turn. An undulating spring 70 (FIG. 7) can also be used.

It will also be appreciated that other relationships than left hand threads can be provided on the reinforcing plate 24 and the bushing 24 to facilitate the clamping between the disc 36 and the reinforcing plate during the operation of the apparatus described above and to facilitate the subsequent release of the disc from the reinforcing plate. For example, the threads on the various members can be partial threads instead of full threads.

FIG. 8 illustrates an arrangement for insuring that the reinforcing plate 24 is retained on the arbor 10. The embodiment shown in FIG. 8 includes a flange 80 on the bushing 16. The flange 80 defines a detent arrangement with a bracing member 82 suitably attached as by a bolt 84 to the reinforcing plate 24. The detent arrangement limits the movement of the reinforcing plate 24 so as to prevent the reinforcing plate from being removed from the arbor 10. In the embodiment shown in FIG. 8, a yieldable member 86 is disposed in a socket 88 on the disc 36 and a projection 89 is disposed on the reinforcing plate 24.

Figure 9:
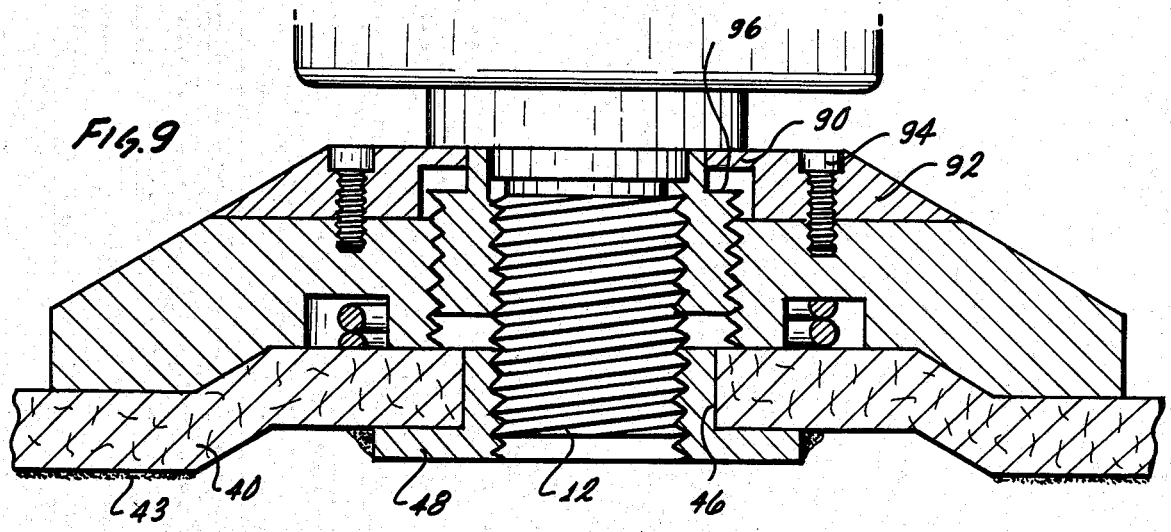
FIG. 9 is a sectional view of a still further embodiment of the holder and the abrasive disc.

FIG. 9 illustrates another arrangement for inhibiting the removal of the reinforcing plate 24 from the arbor 12. The arrangement in FIG. 9 includes a flange 90 on a member 92 which is attached to the reinforcing plate 24 as by a bolt 94. The arrangement further includes a shoulder 96 on the bushing 16. The flange 90 and the shoulder 96 define a detent relationship which limits the movement of the reinforcing plate in a downward direction in FIG. 9.

Although this invention has been disclosed and illustrated with reference to particular embodiments, the principles involved are susceptible for use in numerous other embodiments which will be apparent to persons skilled in the art. The invention is, therefore, to be limited only as indicated by the scope of the appended claims.

I claim:

1. An abrasive article for use with apparatus for holding and rotating the abrasive article for application against a workpiece where the apparatus includes a threaded arbor and a reinforcing plate disposed relative to the arbor for rotation in a particular direction relative to the arbor and where the reinforcing plate has a yieldable clutching member on one surface, including, a disc made from a stiff member and having first and second opposite faces, abrasive particles disposed at least on the first face of the disc for providing an abrading action against the workpiece, there being a bore in the center of the disc, a nut attached to the disc in the bore and at the first face of the disc, the nut being internally bored and threaded to fit on the threaded arbor, and engaging means extending from the second face of the disc in an exposed relationship with respect to the reinforcing plate for cooperation with the yieldable clutching member on the reinforcing plate to act as a clutch for driving the disc with the reinforcing plate.

2. An abrasive article as set forth in claim 1 wherein the disc is internally depressed at the center of the disc and the depression in the disc is greater than the length of the nut to retain the nut in shielded relationship to the first face of the disc.

3. An abrasive article as set forth in claim 1 wherein the disc is made from a phenolic resin and abrasive particles are dispersed throughout the phenolic resin.

4. An abrasive article as set forth in claim 1 wherein the nut has a barrel portion and the barrel portion of the nut is shorter than the thickness of the disc.

5. An abrasive article as set forth in claim 1 wherein the nut abuts the disc only in the bore and at the first face of the disc.

6. An abrasive article as set forth in claim 5 wherein the nut has a barrel portion and the barrel portion of the nut is threaded for rotation on the arbor in a second direction opposite to the particular direction and wherein the second surface of the disc engages the reinforcing plate to produce a rotation of the reinforcing plate relative to the arbor in the particular direction in accordance with the rotation of the disc on the arbor in the second direction.

7. An abrasive article as set forth in claim 1, wherein the nut is disposed in abutting and adhering relationship only with the central bore of the disc and the portion of the first surface of the disc adjacent the central bore.

8. An abrasive article for use with apparatus for holding and rotating the abrasive article for application against a workpiece where the apparatus includes a threaded arbor and a reinforcing plate supported by the arbor and disposed relative to the arbor for rotation in a first direction relative to the arbor and where the reinforcing plate has a yieldable clutching member or one surface, including, a disc made from a stiff material and provided with a central bore and first and second opposite surfaces, there being abrasive particles attached to at least the first surface of the disc, means projecting from the second surface of the disc to external positions on the abrasive article in exposed relationship to the yieldable clutching member on the reinforcing plate, and coupling means disposed in the bore in the disc and having a portion internally threaded for rotation on the arbor in a second direction opposite to the first direction to produce an engagement between the reinforcing plate and the disc and produce a rotation of the reinforcing plate relative to the arbor in the first direction in accordance with the rotation of the disc relative to the arbor in the second direction.

9. An abrasive article as set forth in claim 8 wherein the coupling means has a particular thickness and the disc is depressed at the center of the disc by a distance greater than the thickness of the coupling means.

10. An abrasive article as set forth in claim 9 wherein the engaging means constitutes a projection from the second surface of the disc and wherein means are provided on the reinforcing plate for contacting the engaging means in a yieldable relationship.

11. An abrasive article as set forth in claim 10 wherein the projecting means on the second surface of the disc is firm and is integral with the disc and the contacting means on the reinforcing plate is yieldable.

12. An abrasive article as set forth in claim 10 wherein the engaging means constitutes an annular projection having a V-shape in section.

13. An abrasive article as set forth in claim 8 wherein the engaging means has an annular configuration and is spaced from the central bore of the disc and is disposed between the central bore and the periphery of the disc.

14. An abrasive article as set forth in claim 13 wherein the internally threaded portion of the coupling means has a length less than the thickness of the disc.

15. An abrasive article for use with apparatus for holding and rotating the apparatus for application against a workpiece where the apparatus includes a threaded arbor and a reinforcing plate supported by an arbor and disposed relative to the arbor for rotation in a first direction relative to the arbor and where the reinforcing plate has a yieldable clutching member on one surface, including, a disc made from a stiff material and provided with a central bore and with first and second spaced and substantially parallel surfaces, abrasive particles adhered to at least the first surface of the backing member, means disposed in the central bore of the disc and disposed in abutting and adhering relationship only to the walls of the central bore and to the portion of the first surface of the disc adjacent the central bore for rotation on the arbor in a second direction opposite to the first direction, engaging means extending from the second surface of the disc in exposed relationship to the clutching means on the reinforcing plate for cooperating with the yieldable clutching member on the reinforcing plate to act as a clutch for driving the disc with the reinforcing plate.

16. An abrasive article as set forth in claim 15, including, the engaging means on the second surface of the disc being constructed to engage the the yieldable clutching member on the reinforcing plate in a detent relationship to facilitate the rotation of the reinforcing plate in the first direction in accordance with the rotation of the disc in the second direction.

17. An abrasive article as set forth in claim 15 wherein the means in the central bore of the disc has a length less than the thickness of the disc to terminate at a position which prevents such means from extending beyond the second surface of the disc.

18. An abrasive article as set forth in claim 17, including, the engaging means on the second surface of the disc constituting a projection to facilitate the engagement of the yieldable clutching member by the disc.

19. An abrasive article as set forth in claim 18 wherein the projection on the second surface of the disc is spaced from the central bore of the disc and is provided with an annular configuration.

20. An abrasive article as set forth in claim 19 wherein the projection is disposed on the second surface of the disc between the inner and outer peripheries of the disc.

21. Apparatus for driving an abrasive article constituting a stiff but resilient disc having first and second spaced and parallel surfaces and abrasive particles adhered to at least the first surface of the disc and having a central bore threaded for rotation in a first direction, including, means including an arbor externally threaded in the first direction to receive the threaded bore in the disc for rotation of the disc on the arbor in the first direction, camming means disposed on the arbor to provide for a rotary movement of the camming means in the first direction and further constructed to provide for a movement in a second direction opposite to the first direction at a position spaced from the threads in the first direction, and a reinforcing plate disposed on the camming means in cooperative relationship with the camming means to rotate on the camming means in the second direction against the second surface of the disc when the disc engages the reinforcing plate and is rotated on the arbor in the first direction.

22. Apparatus as set forth in claim 21, including, means disposed on the reinforcing plate for enhancing the engaging action between the reinforcing plate and the disc.

23. Apparatus for driving an abrasive article constituting a stiff but resilient disc having first and second spaced and parallel surfaces and abrasive particles adhered to at least the first surface of the disc and having a central bore threaded for rotation in a first direction, including, means including an arbor threaded in the first direction to receive the threaded bore in the disc for rotation and threaded in a second direction opposite to the first direction at a position spaced from the threads in the first direction, a reinforcing plate disposed on the arbor means at the position of the threads in the second direction and threaded in the second direction for rotation against the second surface of the disc when the disc engages the reinforcing plate and is rotated on the arbor in the first direction, including, means disposed on the reinforcing plate for enhancing the engaging action between the reinforcing plate and the disc, and an adaptor bushing rotatable in the first direction on the arbor and supporting the reinforcing plate for rotation in the second direction.

24. Apparatus as set forth in claim 23, including, means disposed on the reinforcing plate for limiting the movement of the reinforcing plate relative to the arbor to retain the reinforcing plate on the arbor.

25. Apparatus for driving an abrasive article constituting a stiff but resilient backing member having first and second spaced and parallel surfaces and abrasive particles adhered to at least the first surface of the disc and having a central bore threaded for rotation in a first direction, including, an arbor threaded in the first direction to receive the abrasive article and to provide for a movement of the abrasive article on the arbor in the first direction, an adaptor bushing internally threaded in the first direction and disposed on the arbor for rotation in the first direction, and a reinforcing plate disposed in engaging relationship with the adaptor bushing, the adaptor bushing and the reinforcing plate being provided with cooperative constructions and the reinforcing plate being provided with a construction relative to the abrasive article to obtain a rotation of the reinforcing plate relative to the adaptor bushing, in a second direction opposite to the first direction, into a tight coupling with the disc in accordance with the rotation of the abrasive article in the first direction when the disc engages the reinforcing plate.

26. Apparatus as set forth in claim 25, including, means on the reinforcing plate in cooperative relationship with the adaptor bushing for limiting the movement of the reinforcing plate in the second direction on the adaptor bushing.

27. Apparatus as set forth in claim 26, including, means on at least one of the reinforcing plate and the disc for enhancing the engaging action between the reinforcing plate and the disc.

28. In combination, a threaded arbor, means including a disc having first and second opposed surfaces and having a central threaded bore, the disc means being rotatable on the threaded arbor in a first direction, adaptor means disposed on the threaded arbor and constructed to provide for a movement in a second direction opposite to the first direction, a reinforcing plate disposed on the adaptor means and rotatable in the second direction relative to the adaptor means and the threaded arbor when the first surface of the disc engages the reinforcing plate and rotates in the first direction, and abrasive particles on at least the second surface of the disc.

29. A combination as set forth in claim 28, including, means provided on the reinforcing plate and means disposed on the second surface of the disc in cooperative relationship with the means on the reinforcing plate for producing a yieldable clutching relationship between the reinforcing plate and the disc when the disc engages the reinforcing plate.

30. A combination as set forth in claim 29 wherein the disc is depressed at its center adjacent the central bore and a nut is disposed on the disc at the central bore in adhered relationship to the disc and is threaded for rotation on the arbor in the first direction.

31. A combination as set forth in claim 30 wherein means are disposed in cooperative relationship on the adaptor means and the reinforcing plate for limiting the movement of the reinforcing plate relative to the adaptor means in the second direction.

32. A combination as set forth in claim 31 wherein a projection is provided on one of the first surface of the disc and the reinforcing plate and yieldable means are provided on the other one of the reinforcing plate and the first surface of the disc for cooperation with the projection in producing a coupling between the reinforcing plate and the disc.

33. A combination as set forth in claim 30 wherein the nut has a barrel portion and is attached to the disc in the central bore of the disc and in the depressed area of the disc and is provided with a length less than the thickness of the disc.

34. Apparatus as set forth in claim 23, including, the adaptor bushing being internally threaded for rotation on the arbor in the first direction, the adaptor bushing being externally threaded in the second direction and the reinforcing place being internally threaded for rotation on the adaptor bushing in the second direction.

35. Apparatus for driving an abrasive article constituting a stiff but resilient disc having first and second spaced and parallel surfaces and abrasive particles adhered to at least the first surface of the disc and having a central bore threaded for rotation in a first direction, including, means including an arbor threaded in the first direction to receive the threaded bore in the disc for rotation and threaded in a second direction opposite to the first direction at a position spaced from the threads in the first direction, a reinforcing plate disposed on the arbor means at the position of the threads in the second direction and threaded in the second direction for rotation against the second surface of the disc when the disc engages the reinforcing plate and is rotated on the arbor in the first direction, and means disposed on the reinforcing plate for enhancing the engaging action between the reinforcing plate and the disc, the arbor means being threaded in the second direcion and the reinforcing plate being threaded in the second direction for rotation relative to the arbor means against the second surface of the disc when the disc engages the reinforcing plate and is rotated on the arbor in the first direction.

36. A combination as set forth in claim 28 wherein the adaptor means is internally threaded for rotation on the arbor in the first direction and is externally threaded in the second direction and the reinforcing plate is externally threaded for rotation on the adaptor means in the second direction.

37. Apparatus for driving an abrasive article constituting a stiff but resilient backing member having first and second spaced and parallel surfaces and abrasive particles adhered to at least the first surface of the disc and having a central bore threaded for rotation in a first direction, including, an arbor threaded in the first direction to receive the abrasive article, an adaptor bushing internally threaded in the first direction and disposed on the arbor for rotation in the first direction and externally threaded in a second direction opposite to the first direction, and a reinforcing plate disposed on the adaptor bushing and threaded in the second direction for rotation in the second direction in accordance with the rotation of the disc in the first direction when the disc engages the reinforcing plate, the adaptor bushing being externally threaded in a second direction opposite to the first direction and the reinforcing plate being internally threaded in the second direction for rotation relative to the adaptor bushing in the second direction in accordance with the rotation of the disc in the first direction when the disc engages the reinforcing plate.

38. In combination for use with a rotatable arbor and a camming member on the arbor, a reinforcing plate having first and second annular surfaces and having a yieldable clutch member on one surface and being constructed to be cooperative with the camming member to rotate in one direction when the camming member and the arbor rotate in the opposite direction, a disc having first and second surfaces and having abrasive particles on the first surface and having engaging means disposed on the second surface in exposed relationship to the yieldable clutching member for engaging the yieldable clutching member, the reinforcing plate being constructed to provide a firm engagement between the yieldable clutching member and the engaging means upon an initial engagement between the yieldable clutching member and the engaging means and a further rotation of the arbor and the camming member in the first direction.

39. In a combination as set forth in claim 38, the engaging means extends integrally from the second surface of the disc and constitutes a projection.

40. In a combination as set forth in claim 39 wherein the arbor is externally threaded in a first direction and the camming member is internally threaded in the first direction and the camming member is externally threaded in a second direction opposite to the first direction, the reinforcing plate being internally threaded in the second direction to engage the threads in the second direction on the camming member.

41. In combination, a disc made from a stiff material and provided with first and second opposite faces, there being abrasive particles attached to the first surface of the disc, engaging means extending from the second surface of the disc, a reinforcing plate a yieldable clutching member disposed on the reinforcing plate for engaging the engaging means on the second surface of the disc, the engaging means being externally exposed relative to the yieldable clutching member, and means for providing a rotation of the reinforcing plate into a firm engagement between the yieldable clutching member on the reinforcing plate and the engaging means on the second surface of the disc when the projection on the second surface of the disc initially engages the yieldable clutching member on the reinforcing plate and is further rotated in a direction opposite to the direction of the firm engagement between the yieldable clutching member and the engaging means.

42. In a combination as set fotth in claim 41, the engaging means constituting a projection extending integrally from the second surface of the disc.

43. In a combination as set forth in claim 41, the disc being provided with an opening at its center and an internally threaded nut being disposed in the opening in the center of the disc and being affixed to the disc and the engaging means constituting an annular projection extending integrally from the second surface of the disc and the yieldable clutching member being annular.

44. In a combination as set forth in claim 1 wherein the engaging means is integral with the disc and constitutes projection extending from the second surface of the disc.

45. An abrasive article as set forth in claim 20 wherein the annular projection has a V-shape in section.

* * * * *